US006125806A

United States Patent [19]

Nishi et al.

[11] Patent Number: 6,125,806

[45] Date of Patent: Oct. 3, 2000

[54] VALVE DRIVE SYSTEM FOR ENGINES

[75] Inventors: Kengo Nishi; Yuji Saiki; Matsunori Narita; Toshiyuki Takahashi, all of Iwata, Japan

[73] Assignee: Yamaha Hatsudoki Kabushiki Kaisha, Shizouka-ken, Japan

[21] Appl. No.: 09/339,145

[22] Filed: Jun. 24, 1999

[30] Foreign Application Priority Data

| | | | |
|---|---|---|---|
| Jun. 24, 1998 | [JP] | Japan | 10-177063 |
| Jul. 16, 1998 | [JP] | Japan | 10-201615 |
| Jul. 24, 1998 | [JP] | Japan | 10-209500 |

[51] Int. Cl.[7] ..... F01L 1/18

[52] U.S. Cl. ..... 123/90.27; 123/90.41; 123/90.44

[58] Field of Search ..... 123/90.22, 90.27, 123/90.39, 90.4, 90.41, 90.44, 90.6

[56] References Cited

U.S. PATENT DOCUMENTS

| | | | |
|---|---|---|---|
| 2,345,822 | 4/1944 | Leake . | |
| 2,678,641 | 5/1954 | Ryder . | |
| 3,618,574 | 11/1971 | Miller | 123/90.18 |
| 3,722,484 | 3/1973 | Gordini . | |
| 4,635,592 | 1/1987 | Weichsler | 123/90.18 |
| 4,850,311 | 7/1989 | Sohn | 123/90.18 |
| 5,347,964 | 9/1994 | Reguiero | 123/90.22 |
| 5,445,117 | 8/1995 | Mendler | 12/90.16 |
| 5,570,665 | 11/1996 | Regueiro | 123/90.27 |
| 5,645,023 | 7/1997 | Regueiro | 123/90.27 |
| 5,669,344 | 9/1997 | Regueiro | 123/90.22 |
| 5,803,033 | 9/1998 | Naruoka | 123/90.18 |

FOREIGN PATENT DOCUMENTS

| | | |
|---|---|---|
| 0 843 078 A | 5/1988 | European Pat. Off. . |
| 0 669 452 A | 8/1995 | European Pat. Off. . |
| 39 43 727 A | 2/1994 | Germany . |
| 432 346 A | 4/1935 | United Kingdom . |

OTHER PUBLICATIONS

Patents Abstract of Japan, vol. 008, No. 124 (M–301), Jun 9, 1994 & JP 59 029709 A (Honda Giken Kogyo KK), Feb. 17, 1984.

*Primary Examiner*—Wellun Lo

*Attorney, Agent, or Firm*—Knobbe, Martens, Olson & Bear LLP

[57] ABSTRACT

In a valve drive system, a plurality of intake or exhaust valves are disposed radially in a cylinder, and the intake or exhaust valves each are driven by respective rocker arms supported for rotation on a cylinder head via a rocker pin and an intake or exhaust cam shaft having three-dimensional cams for engaging these rocker arms. A boss of the rocker arm is coupled to the rocker pin for tilting movement in a direction perpendicular to the axis of the rocker pin. The rocker arm is tiltable with respect to the rocker pin to follow the three-dimensional cam surface. The cam surface can be in line contact with the sliding surface of the rocker arm throughout its circumference.

8 Claims, 13 Drawing Sheets

VALVE DRIVE SYSTEM FOR ENGINES

This application claims priority under 35 U.S.C. §119 based on Japanese patent applications No. 10-177063, filed Jun. 24, 1998, No. 10-209500, filed Jul. 24, 1998, and No. 10-201615, filed Jul. 16, 1998.

BACKGROUND OF THE INVENTION

1. Field of the Invention

This invention relates to a valve drive system for an engine in which radially disposed intake and exhaust valves are driven by intake and exhaust cam shafts.

2. Description of the Related Art

A system having four intake and exhaust valves radially disposed for each cylinder is known as an engine provided with a semi-spherical combustion chamber to improve combustion efficiency. In the valve drive system used for this type of engine, because the opening/closing directions of the intake and exhaust valves are different for each valve with respect to the direction perpendicular to the axes of the cam shafts, complicated structures are adopted to transmit the rotation force of the cam shafts to each valve (see JP-A-59-29709, for example).

The valve drive system disclosed in the patent publication is arranged in such a way that one cam shaft is supported in the center of a cylinder head for rotation. A cam surface of the cam shaft is formed parallel to the axial direction of the cam shaft, and two rocker arms are disposed for each intake or exhaust valve between the cam surface and the intake or exhaust valve.

A first rocker arm of one of the two rocker arms is supported for rocking movement on a first support shaft mounted parallel to the cam shaft, and has one end engaged with the cam surface and the other end extending toward the intake or exhaust valve. A second rocker arm is supported for rocking movement on a second support shaft mounted in a direction perpendicular to the axis of the intake or exhaust valve, and has an underside of the rocking end in contact with the intake or exhaust valve. The opposite side (top surface) to the intake or exhaust valve at the rocking end is engaged with the other end of the first rocker arm. That is, the valve drive system is arranged in such a way that movement of the cam surface is converted, by two rocker arms, to movement in a direction parallel to the axis of the intake or exhaust valve.

However, the valve drive system described above has problems of high manufacturing costs and large size because the number of the rocker arms used is high. In order to construct one rocker arm for one intake or exhaust valve to reduce the costs and downsize the system, it is contemplated that the system is arranged in such a way that the cam surface is inclined perpendicular to the axial direction of the intake or exhaust valve, thereby forming a three-dimensional cam and is engaged with the second rocker arm in a sliding relationship.

However, in implementation of this system, a problem arises in lubrication of the contact portion between the three-dimensional cam and the rocker arm. The lubrication of the contact portion is achieved by an oil film of lubricating oil formed between the cam surface of the three-dimensional cam and the sliding surface of the rocker arm. It is well known that the oil film is maintained when the foregoing two components are in line contact, but is broken when they are in point contact.

When the three-dimensional cam is manufactured as an industrial product, the contact state between the cam surface and the foregoing sliding surface tends to be in point contact due to manufacturing defects of the cam surface, and breakage of the oil film leads to wear of the sliding portion. Forming a highly accurate three-dimensional cam surface requires very long grinding work hours, resulting in a significant cost increase.

In order to solve the foregoing problems, an objective of the present invention is to provide a valve drive system capable of utilizing three-dimensional cams without decreasing lubricating capacity or increasing the cost and capable of effecting a cost reduction and downsizing the system by decreasing the number of rocker arms compared with the conventional valve drive systems.

Further, a conventional three-dimensional cam is used as described above, in order that the three-dimensional cam and the rocker arm slipper are in line contact with each other. However, the contact portions of both components must be precision-machined using special grinding machines, raising problems of longer processing time and higher processing cost.

In view of the above, an objective of another embodiment of the present invention problems is to provide a valve driving mechanism for the internal combustion engine that makes it possible to realize the line contact between the intake and exhaust cams and the rocker arms without requiring high precision machining so that friction and heat generation on the sliding surfaces of both components are restricted.

Furthermore, in a conventional sports type, i.e., high revolution engines with a small angle between valve axes and a large angle between the intake and the exhaust passage axes, it is difficult to dispose rocker arms around the cylinder center. That is, in a constitution in which a common rocker shaft passes through a rocker shaft hole bored across multiple cylinders, the rocker shaft hole will end up in intersecting the plug hole. Further, it is impossible to make by machining a long, small-diameter rocker shaft hole while maintaining a high precision of parallelism between the rocker shaft hole and the camshaft.

On the other hand, when a constitution is employed in which the rocker shaft is disposed outside the camshaft, arrangement of the intake and exhaust passages inevitably becomes disadvantageous.

In view of the above, an objective of yet another embodiment of the present invention is to provide a valve driving mechanism for a multi-cylinder engine which makes it possible to employ an integral type of cylinder head while disposing rocker shafts between intake and exhaust camshafts, and to increase rigidity of supporting the rocker arms by supporting them within a compact arrangement.

SUMMARY OF THE INVENTION

The invention is characterized, in an embodiment, by a valve drive system in which a plurality of intake or exhaust valves are disposed radially in a cylinder, and the intake or exhaust valves each are driven by respective rocker arms supported for rotation on a cylinder head via a rocker pin and an intake or exhaust cam shaft having three-dimensional cams for engaging these rocker arms. In the above, the boss of the rocker arm is coupled to the rocker pin for tilting movement in a direction perpendicular to the axis of the rocker pin.

According to this embodiment of the present invention, the rocker arm is tiltable with respect to the rocker pin so as to follow the three-dimensional cam surface, so that the cam surface can be in line contact with the sliding surface of the rocker arm throughout its circumference.

An engine valve drive system according to another embodiment of the present invention is characterized by the engine valve drive system described above, wherein a position, where the three-dimensional cam is engaged with the rocker arm, is located closer to the rocker pin than is a position where the rocker arm is engaged with the intake or exhaust valve.

According to this embodiment of the present invention, compared with the system in which the three-dimensional cam is engaged with the rocker arm at a position corresponding to the intake or exhaust valve, the movement of the three-dimensional cam in a vertical direction can be set relatively low for a given opening degree of the intake or exhaust valve.

Yet another embodiment of the present invention is characterized by the valve drive system for engines described above, wherein the rocker pin is inclined with respect to the axis of the cam shaft when viewed from the direction of the cylinder axis.

According to this embodiment of the present invention, the rocker arm is able to rock along the stroking direction of the intake or exhaust valve.

To accomplish the above object, the invention of claim 1 is a valve driving mechanism for an internal combustion engine, wherein intake and exhaust valves are disposed radially, and rotation of intake and exhaust camshafts is converted through rocker arms into sliding movement of the intake and exhaust valves to open and close the intake and exhaust ports, characterized in that a slipper for the rocker arm is made as a separate component and supported for swinging freely.

Further, yet another embodiment of the present invention is characterized in that a holder which is separate from a cylinder head is attached to the cylinder head, with the holder being made to support the rocker arm.

In the above, other embodiments may be characterized in that (1) the intake and exhaust cams formed on the intake and exhaust camshafts are made in three-dimensional shapes; (2) the rocker shafts for rotatably supporting the rocker arms are tilted in side view relative to the intake and exhaust camshafts; and/or (3) bearings for supporting the intake and exhaust camshafts are disposed between a plural number of adjacent intake and exhaust valves.

DETAILED DESCRIPTION OF THE PREFERRED EMBODIMENT

The present invention includes various embodiments such as those explained below.

First Embodiment

A first embodiment of a valve system for engines according to the present invention will be described in detail with reference to FIGS. 1–5.

Figure 1:
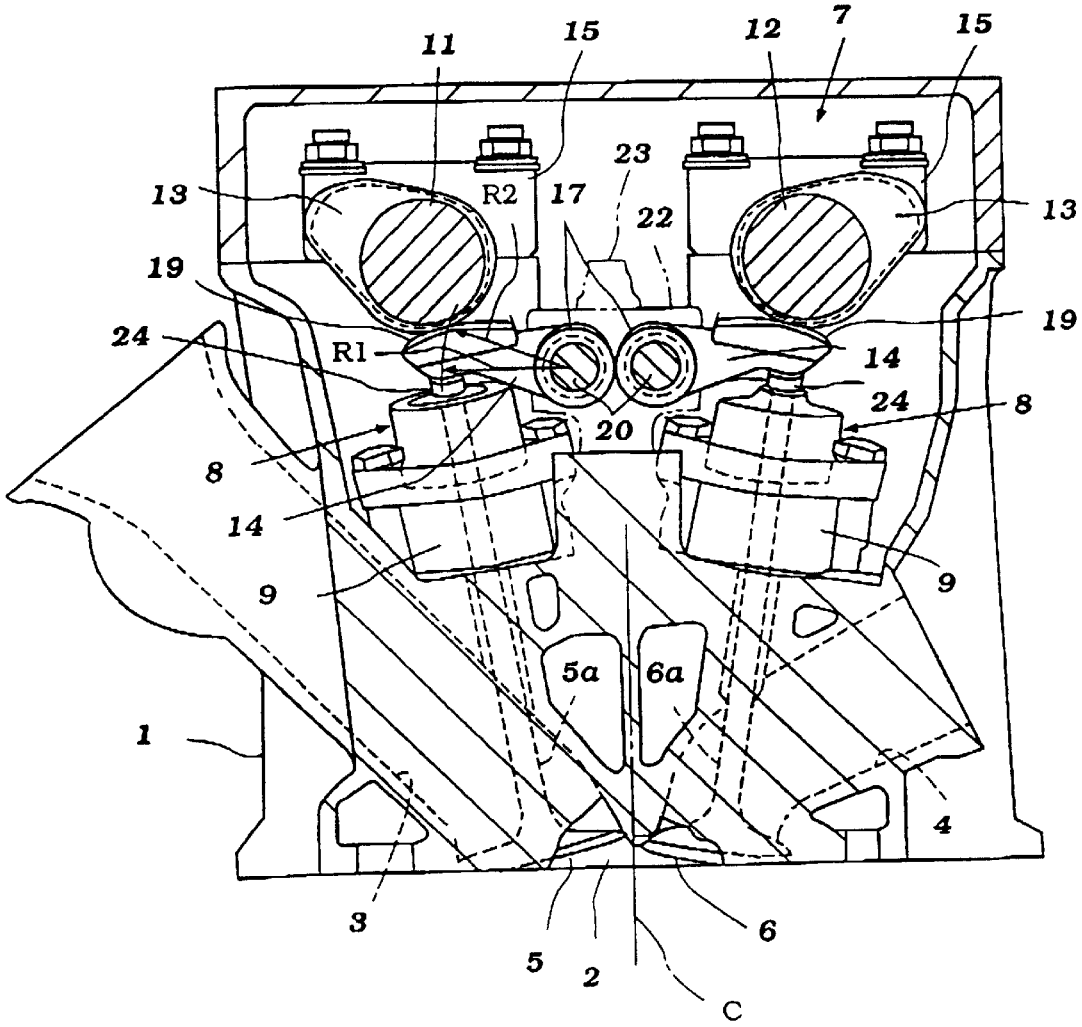
FIG. 1 is a sectional view of an engine incorporating a valve drive system according to a first embodiment.
Figure 2:
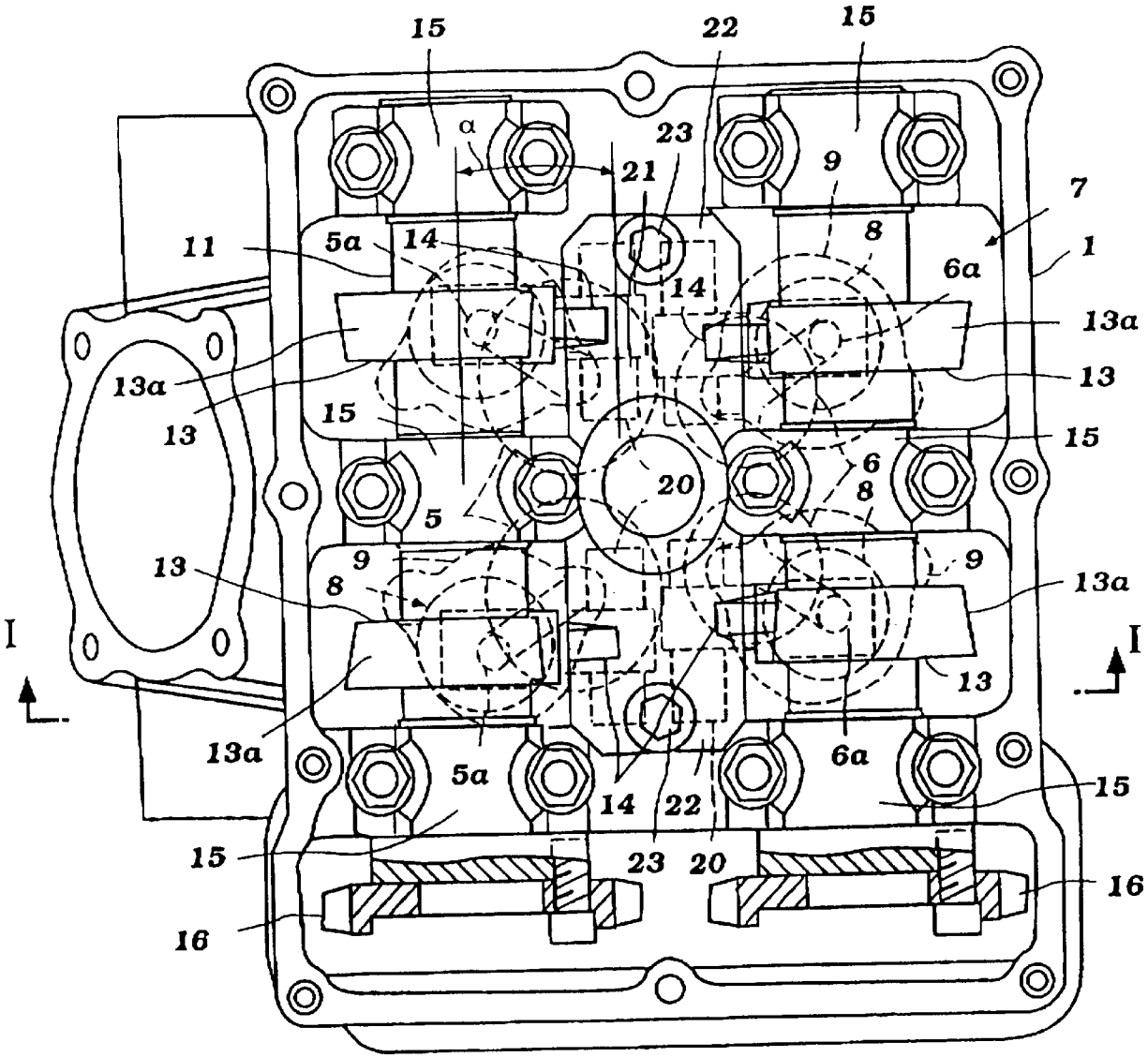
FIG. 2 is a plan view of a cylinder head, wherein a broken position of FIG. 1 is shown with line I—I.
Figure 3:
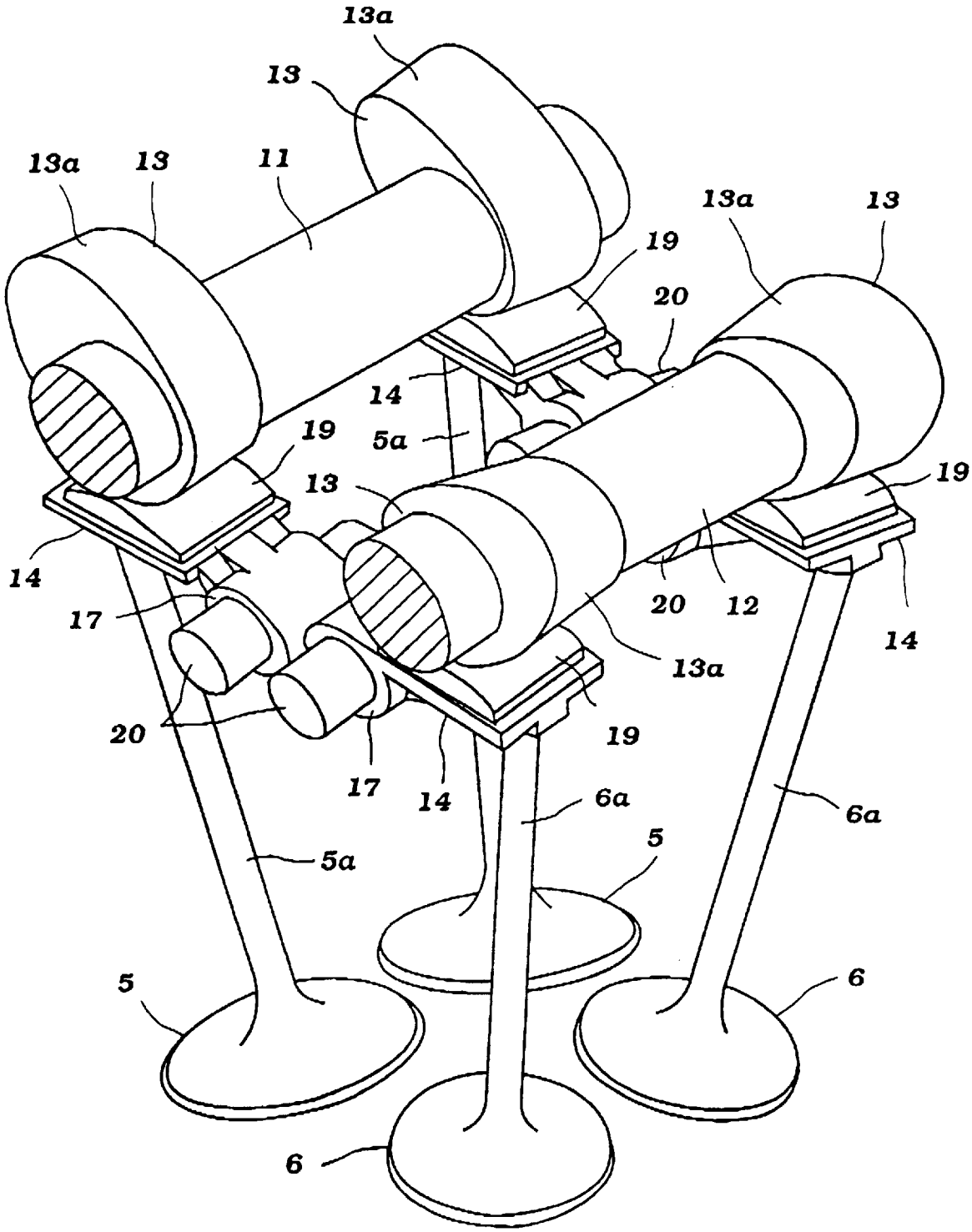
FIG. 3 is a perspective view showing the structure of the valve drive system.

FIG. 1 is a sectional view of an engine incorporating a valve drive system according to the first embodiment, and FIG. 2 is a plan view of a cylinder head, wherein a broken position of FIG. 1 is shown with line I—I. FIG. 3 is a perspective view showing the structure of the valve drive system, and FIGS. 4(*a*), 4(*b*), and 4(*c*) are views showing rocker arm, wherein FIG. 4(*a*) is a plan view, FIG. 4(*b*) is a side view, and FIG. 4(*c*) is a front view as can be seen from the slipper side. FIG. 5 is a sectional view of a boss of the rocker arm, along with line V—V of FIG. 4(*b*).

In these figures, numeral 1 designates a cylinder head of an engine according to this embodiment. The cylinder head 1 is for a water-cooled single-cylinder DOHC type engine, and formed with an approximately semi-spherical combustion chamber 2, and two sets of an intake port 3 and exhaust port 4 connected to the combustion chamber 2. Between these ports 3, 4, i.e., in the center of the combustion chamber 2, an ignition plug is attached (not shown).

Two intake valves 5 for opening/closing the intake ports 3 and two exhaust valves 6 for opening/closing the exhaust port 4 are disposed such that valve shafts 5*a*, 6*a* extend radially from the combustion chamber 2 when viewed from an axial direction of the cylinder, as shown in FIG. 2. These intake and exhaust valves 5, 6 are driven by a valve drive system 7 as described hereinafter. The axis of the cylinder is shown in FIG. 1 with a single dot and dash line C.

Components, through which valve stems 5*a*, 6*a* of the intake and exhaust valves 5, 6 pass, as indicated in FIG. 1 with numeral 8, are spring retainers for retaining valve springs (not shown) for biasing the intake and exhaust valves 5, 6 in the valve closing direction. The spring retainer 8 is formed in a bottomed-cylindrical shape with a bottom (upper side in FIG. 1) penetrated by the intake or exhaust valve 5 or 6, and fitted for sliding movement in a retaining cylinder 9 fixed to the cylinder head 1. The valve spring is spring loaded between the inner bottom of the spring retainer 8 and the cylinder head 1.

The valve drive system 7 for driving the intake and exhaust valves 5, 6 comprises an intake cam shaft 11 and exhaust cam shaft 12, and rocker arms 14, one for each of the intake and exhaust valves, engaged with three-dimensional cams 13 of these cam shafts 11, 12.

The intake cam shaft 11 and exhaust cam shaft 12 are provided with the three-dimensional cams 13 at positions corresponding to the intake and exhaust valves 5, 6, and supported for rotation on the cylinder head 1 by a well-known support structure. Cam caps journaling these cam shafts 11, 12 on the cylinder head are designated by numeral 15 in FIGS. 1 and 2. These cam shaft 11, 12 each are arranged in such a way that a timing chain sprocket 16 is fixed at one end (lower end in the figure), and the rotation of the crank shaft (not shown) is transmitted through the timing chain (not shown) stretched between the sprocket 16 and the crank shaft.

Lubrication of the bearing for supporting both of the cam shafts 11, 12 for rotation and the sliding portions between the three-dimensional cams 13 and the rocker arms 14, is performed by supplying lubricating oil from lubricating oil passages (not shown) formed in the cam shafts 11, 12 to the sliding portions.

The three-dimensional cam 13, as shown in FIGS. 2 and 3, is formed with a cam surface 13*a* inclined in such a way that its diameter is decreased from one end toward the other end of the cam in the axial direction. The inclined angles of the cam surfaces 13*a* are set so as to correspond to the inclined angles of the valve stems 5*a*, 6*a* of the intake and exhaust valves 5, 6 with respect to the axes of the cam shafts 11, 12, in such a way that the cam surfaces 13*a* in sliding engagement with the rocker arms 14 are parallel, at the contact portions, to the planes perpendicular to the axes of the intake and exhaust valves 5, 6.

Figure 4A:
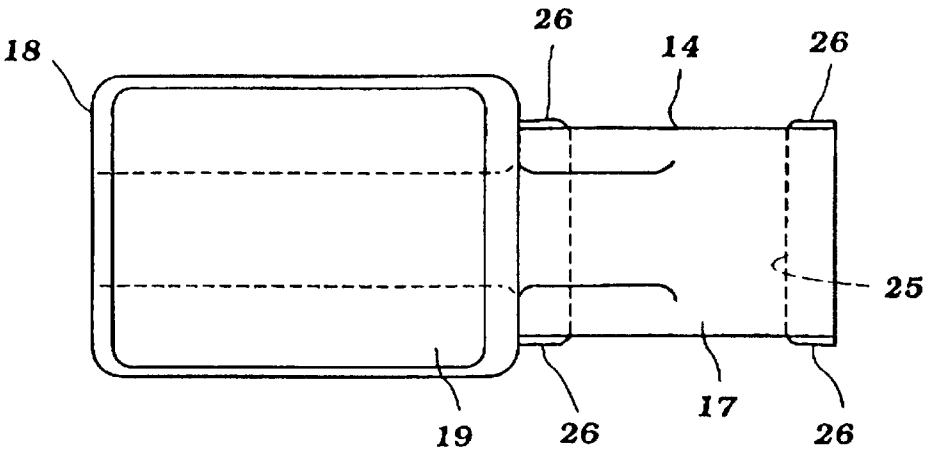
FIGS. 4(*a*), 4(*b*), and 4(*c*) are views showing rocker arm, wherein FIG. 4(*a*) is a plan view, FIG. 4(*b*) is a side view, and FIG. 4(*c*) is a front view as can be seen from the slipper side.
Figure 4B:
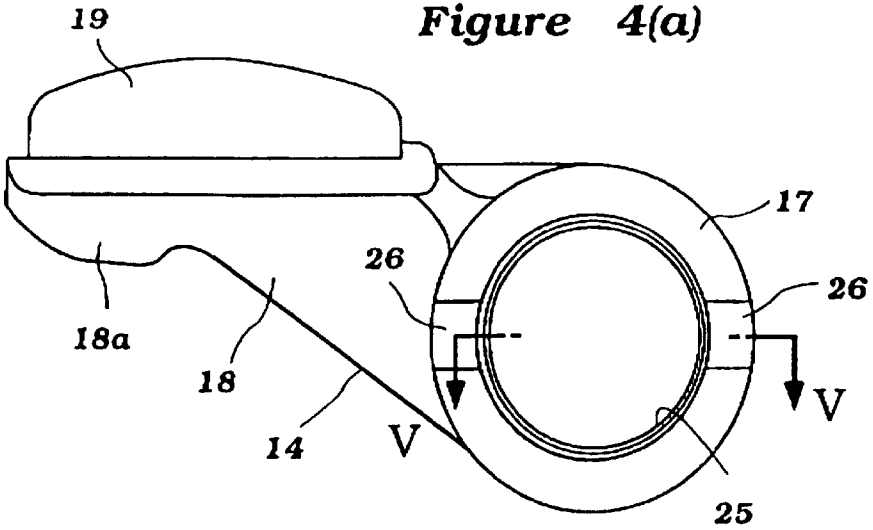
Figure 4C:
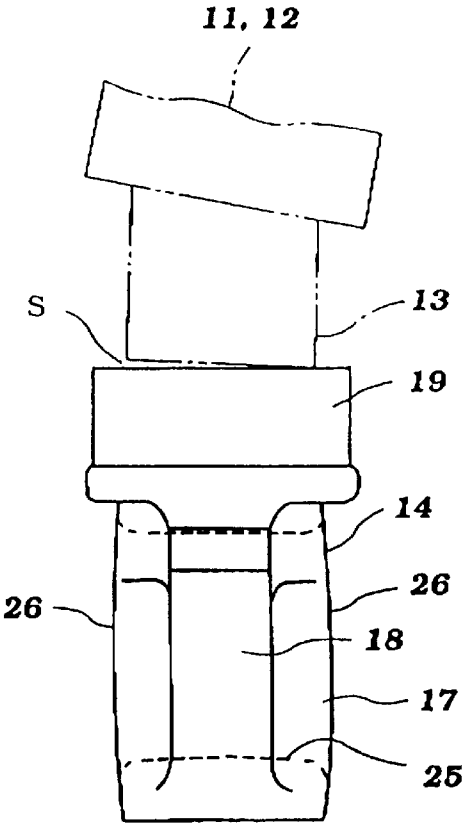
Figure 5:
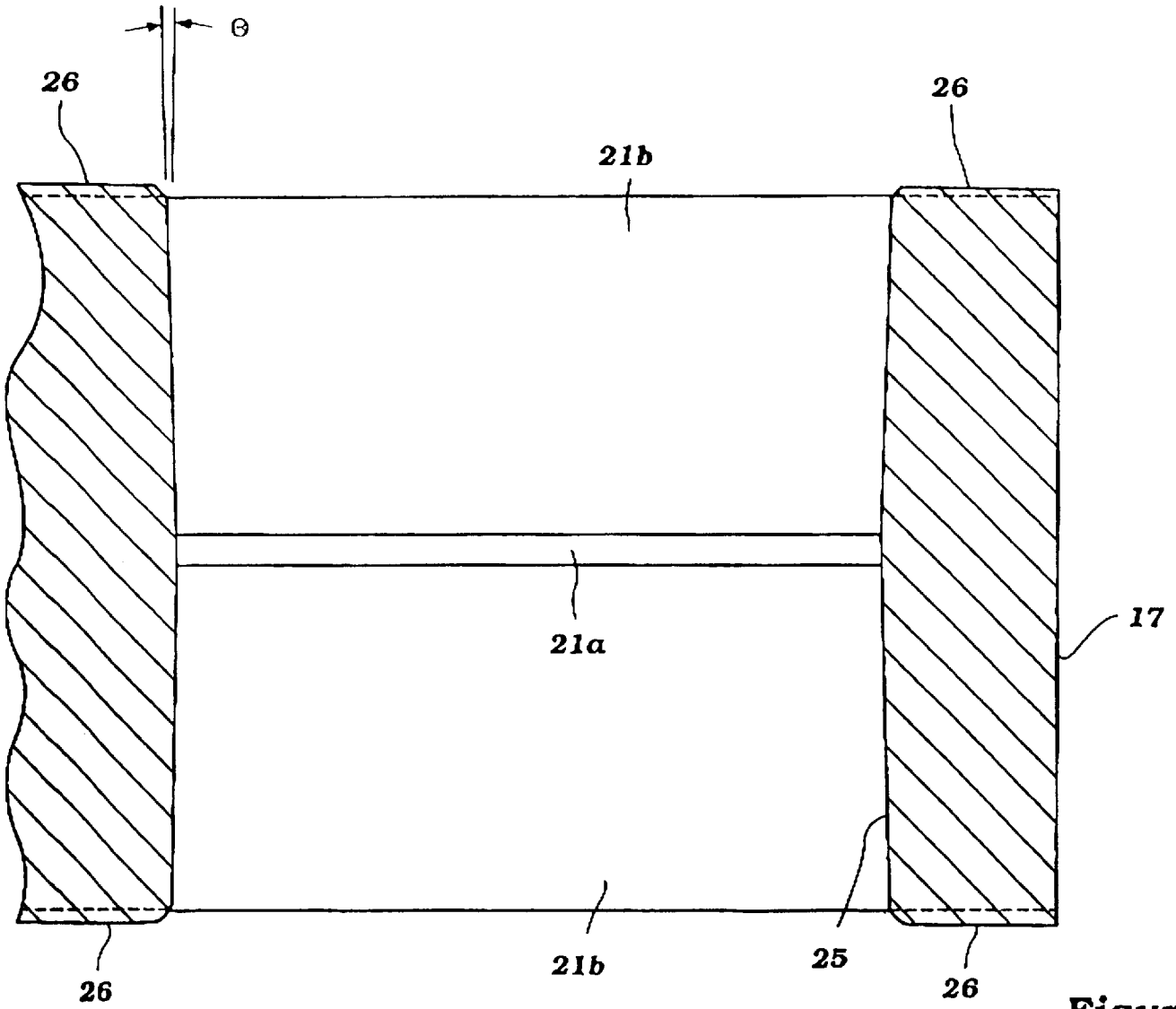
FIG. 5 is a sectional view of a boss of the rocker arm, along with line V—V of FIG. 4(*b*).

The rocker arm 14 is formed, as shown in FIG. 4, in such a way that a cylindrical boss 17, and an arm 18 protruding in one direction from the boss 17, are molded integrally, and slipper 19 engaged with the three-dimensional cam 13 of the cam shaft 11 or 12 is fixed to the arm 18. The rocker arm 14 is, as shown in FIGS. 1 and 2, fitted, at the boss 17, on a columnar rocker pin 20 of a constant diameter, and supported, for rotary movement, on the cylinder head 1 through the rocker pin 20. The boss 17 constitutes the base section of the rocker arm 14 of this embodiment.

These rocker arms 14 and rocker pins 20 are inclined so as to correspond to the intake and exhaust valves 5, 6 inclining with respect to the axes of the cam shafts 11, 12. That is, as with the cam surface 13*a*, they are inclined so as to be parallel to the planes perpendicular to the axes of the intake and exhaust valves 5, 6. Specifically, the rocker pins 20, as shown in FIG. 2, are inclined by angle $\alpha$ with respect to the axes of the cam shafts 11, 12 so as to correspond to the inclination of the intake and exhaust valves 5, 6 when viewed from the axial direction of the cylinder. The angle $\alpha$ is set at approximately one degree for this embodiment. Similarly, the rocker pins 20 are inclined with respect to the axes of the cam shafts 11, 12 when viewed from the direction of cam shafts 11, 12 (see FIG. 3). The rocker pin 20 for the intake valve 5 and the rocker pin 20 for the exhaust valve 6 on the left-hand side in FIG. 3, and the two rocker pins 20 on the other side, are inclined so as to assume an inverse straddle shape when viewed from the direction of the cam shafts 11, 12. This inclination of the rocker pins 20 allows the rocker arms 14 to rock along a stroking direction of the intake and exhaust valves 5, 6, so that the intake and exhaust valves 5, 6 can be disposed without undesirable bending load.

The rocker pin 20 is fixed to the cylinder head 1 in such a way that one end of the rocker pin 20 on the side of cylinder axis C is fitted in a center projection 21 (see FIG. 2) formed integrally with the cylinder head 1, and the other end is fitted in a rocker pin holder 22. The rocker pin holder 22 is formed separately from the cylinder head 1 and fixed to the cylinder head I with fixing bolts 23.

The arm 18 of the rocker arm 14 is formed, at the tip, with an integral pushing projection 18*a* for engaging an end cap 24 attached to the valve stem end of the intake or exhaust valve 5 or 6, as shown in FIG. 1, and a slipper 19 is mounted fixedly on the opposite side (upper side in FIG. 1) of the arm 18 from the pushing projection 18*a*. The slipper 19 is formed in the shape with a quadratic surface such that it is convexed on the cam shaft side and extends in the axial direction of the cam shafts 11, 12.

In the embodiment, the length and the mounting position of the rocker arm 14, and the mounting position of the cam shaft 11 or 12 are set in such a way that distance R1 from the contact point between the pushing projection 18*a* and the end cap 24 to the rotation center (axial center of the rocker pin 20) is larger than the distance R2 from the rotation center to the contact point between the slipper 19 and the three-dimensional cam 13.

A pin hole 25 in which the rocker pin 20 is fitted at the boss 17 of the rocker arm 14 is configured, as shown in FIG. 5, in such a way that the inside diameter is constant in the axially central portion and increased gradually from the central portion toward the open end. The central portion with a constant diameter is shown in FIG. 5 with numeral 21*a*, and the portions of tapered hole with gradually changing diameters are shown with numeral 21*b*. Wall surface inclination angle $\theta$ is set, for example, at approximately 0.5–2 degrees.

Thus, taper formation of the opening side of the pin hole 25 allows the rocker arm 14 to be tilted in the direction perpendicular to the axis of the rocker pin 20, with the rocker pin 20 fitted in the pin hole 25.

Further, the rocker arm 14 is formed with a plurality of projections 26 on the axial end face of the boss 17, as shown in FIG. 4. These projections 26 are formed so as to be in contact with the end face of the center projection 21 of the cylinder head 1 and the end face of the rocker pin holder 22. Due to the projections 26 formed on the end face of the boss 17 in this way, the tilting direction of the rocker arm 14 with respect to the rocker pin 20 can be limited. That is, as shown in FIG. 4, forming the projections on both sides of the boss 17 (both sides in the direction perpendicular to the axes of the cam shafts 11,12 and the cylinder axis C) allows the rocker arm 14 to be tilted clockwise or counter-clockwise in FIG. 4(*c*).

In the valve drive system 7 as described above, the rotation of the intake cam shaft 11 and exhaust cam shaft 12 is transmitted from the tree-dimensional cams 13 to the rocker arms 14, and the rocker arms 14 are rotated about the rocker pins 20 to open/close the intake-dimensional cam 13 and slipper 19 of the rocker arm 14, an oil film of the lubricating oil is retained when the inclination angle of the cam surface 13*a* coincides with that of the contact surface of the slipper 19, thereby providing good lubrication.

When the angel of the cam surfer 13*a* does not coincide with that of the sliding surface, due to manufacturing defects of the three-dimensional cam 13, i.e., when both surfaces are in point contact and a clearance S is provided between them, as shown in FIG. 4(*c*) with double dots and dash lines, the rocker arm 14 is tilted with respect to the rocker pin 20 in such a way that the clearance S is eliminated. In other words, the rocker arm 14 is tiltable with respect to the rocker pin 20 so as to follow the cam surface 13*a* of the three-dimensional cam 13, so that the cam surface 13*c* becomes in line contact throughout with the sliding surface of the slipper 19.

Therefore, according to this valve drive system 7, an oil film of the lubricating oil can securely be maintained between the cam surface 13*a* and the sliding surface of the slipper 19 without the need of highly accurately forming the three-dimensional cam 13.

Second Embodiment

To couple the rocker arm 14 to the rocker pin 20 for tilting movement, a coupling sleeve may be disposed between the boss 17 and the rocker pin 20.

Figure 6:
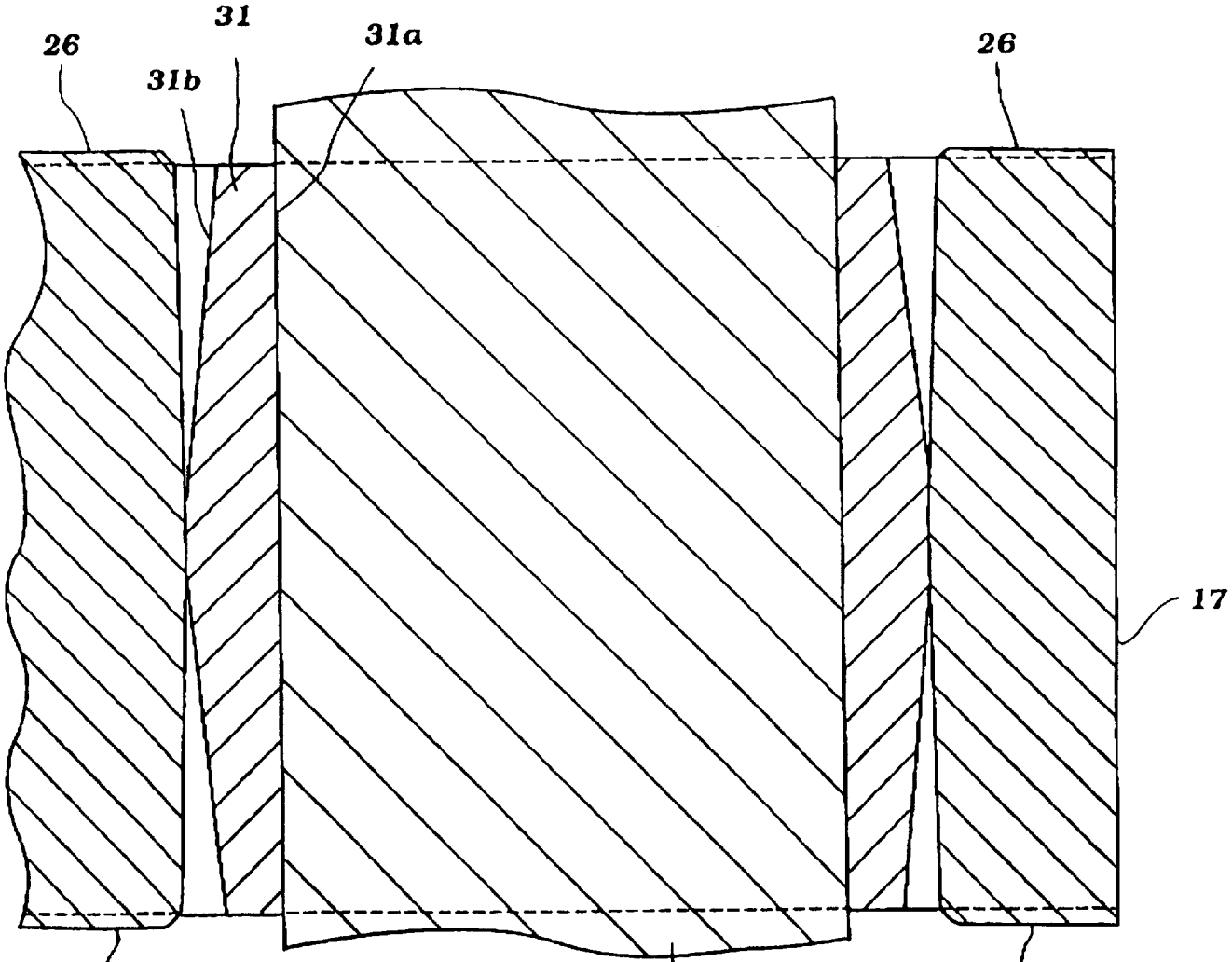
FIG. 6 is an enlarged view of a portion of a second embodiment of the valve drive system for engines.

FIG. 6 is an enlarged sectional view of a portion of another embodiment of the valve drive system for engines according to the present invention. Parts similar or equivalent to those illustrated in FIGS. 1–5 are designated by corresponding reference numerals, omitting detailed descriptions.

The rocker arm 14 shown in FIG. 6 is coupled to the rocker pin 20 through a cylindrical sleeve 31. The sleeve 31 is configured in such a way that an inner circumference 31*a* has a constant diameter and an outer circumference 31*b* has diameters gradually decreasing from the axially-central portion toward the end portion. The rocker 20 is received in the inner circumference 31 a, and the outer circumference is fitted in the pin hole 25 of the rocker arm 14. In this embodiment, the axially-central portion of the outer circumference 31*b* of the sleeve 31 has a constant diameter.

According to this embodiment, manufacture of the valve drive system 7 is simple compared with the first embodiment. This is because formation of the tapered surface on the outer circumference 31*b* of the sleeve 31 is simpler than is formation of the tapered surface in the pin hole 25 of the rocker arm 14.

In the foregoing embodiments, description has been made on examples in which all the intake valves 5 and exhaust valves 6 are disposed radially, but only two intake valves 5 may be disposed radially whereas two exhaust valves 6 are disposed parallel to each other, or on the contrary, two exhaust valves 6 may be disposed radially whereas two intake valves are disposed parallel to each other. Also, the number of the intake valves 5 or exhaust valves 6 may be changed as appropriate, for example, three intake valves 5 and two exhaust valves 6.

Effects Exhibited in the Above Embodiments

As understood in the above, according to an embodiment, the rocker arm is tiltable with respect to the rocker pin so as to follow the three-dimensional cam surface, so that the cam surface can be in line contact with the sliding surface of the rocker arm throughout its circumference.

Therefore, an oil film of lubricating oil can securely be maintained between the cam surface and the sliding surface of the rocker arm without the need of highly accurately forming a three-dimensional cam. Thus, the valve drive system according to the embodiment of the present invention is able to utilize the three-dimensional cam to reduce the number of the rocker arms while improving productivity of the three-dimensional cam and durability of the sliding portion, thereby effecting a cost reduction and downsizing the system.

According to another embodiment of the present invention, the contact position between the rocker arm and the three-dimensional cam is located closer to the rocker pin. The degree of lifting the three-dimensional cam can be set relatively low and the length of the rocker arm can be shorter for a given opening degree of the intake or exhaust valve, compared with a system in which the three-dimensional cam is engaged with the rocker arm at a position corresponding to the intake or exhaust valve or at a position which is further away from the rocker pin than is the position corresponding to the intake or exhaust valve.

Therefore, the inertial mass of the three-dimensional cam and the rocker arm can be smaller, thereby providing a valve drive system suitable for high-speed type engines.

According to yet another embodiment of the present invention, the rocker pin is tiltable with respect to the cam shaft. The rocker arm is able to rock along the stroking direction of the intake or exhaust valve, and therefore the intake or exhaust valve can be disposed without undesired bending load.

Embodiments

Third Embodiment

Figure 7:
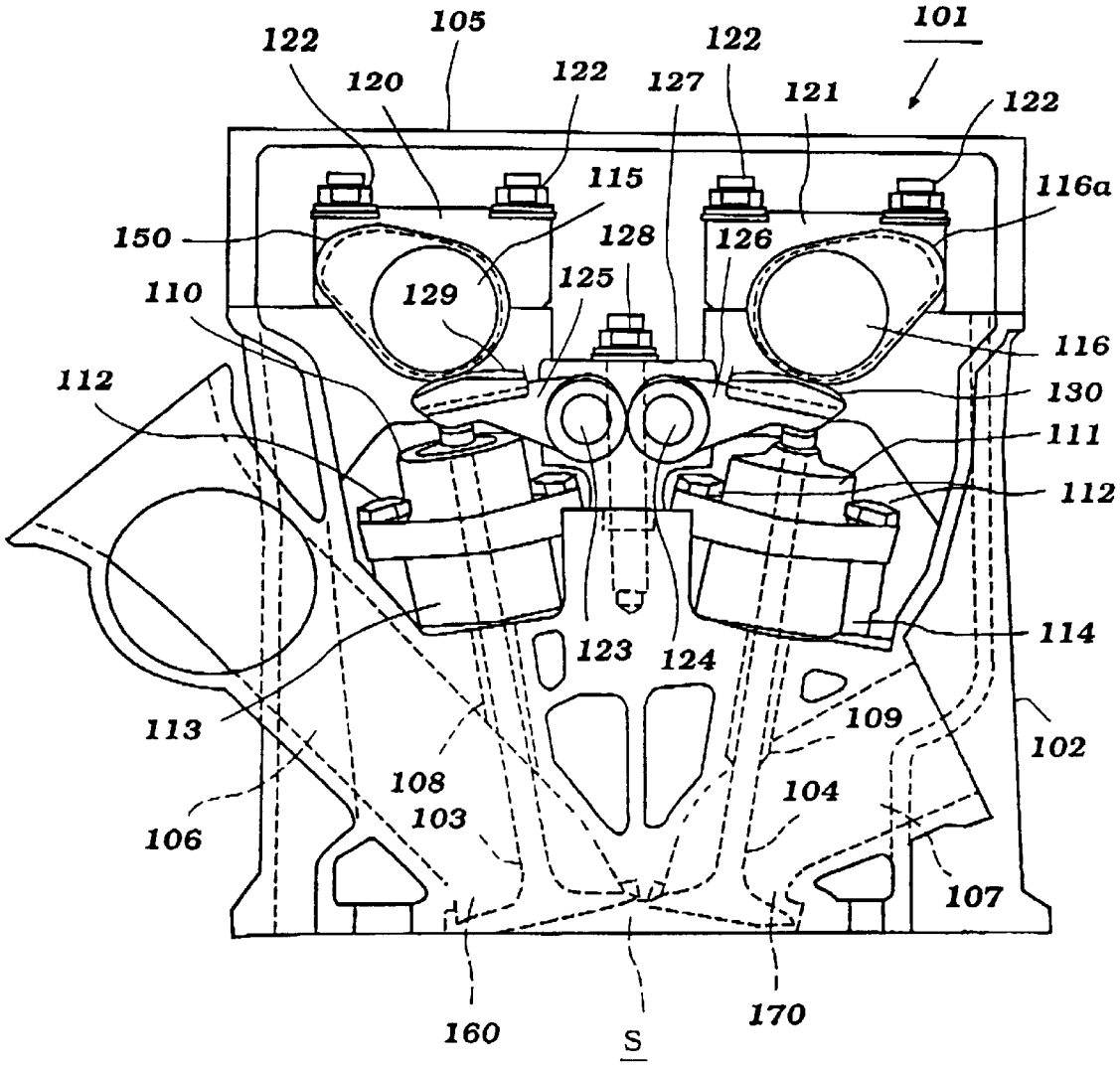
FIG. 7 shows a lateral cross section of an upper portion (cylinder head portion) of an internal combustion engine provided with the valve driving mechanism according to another embodiment of the invention.
Figure 8:
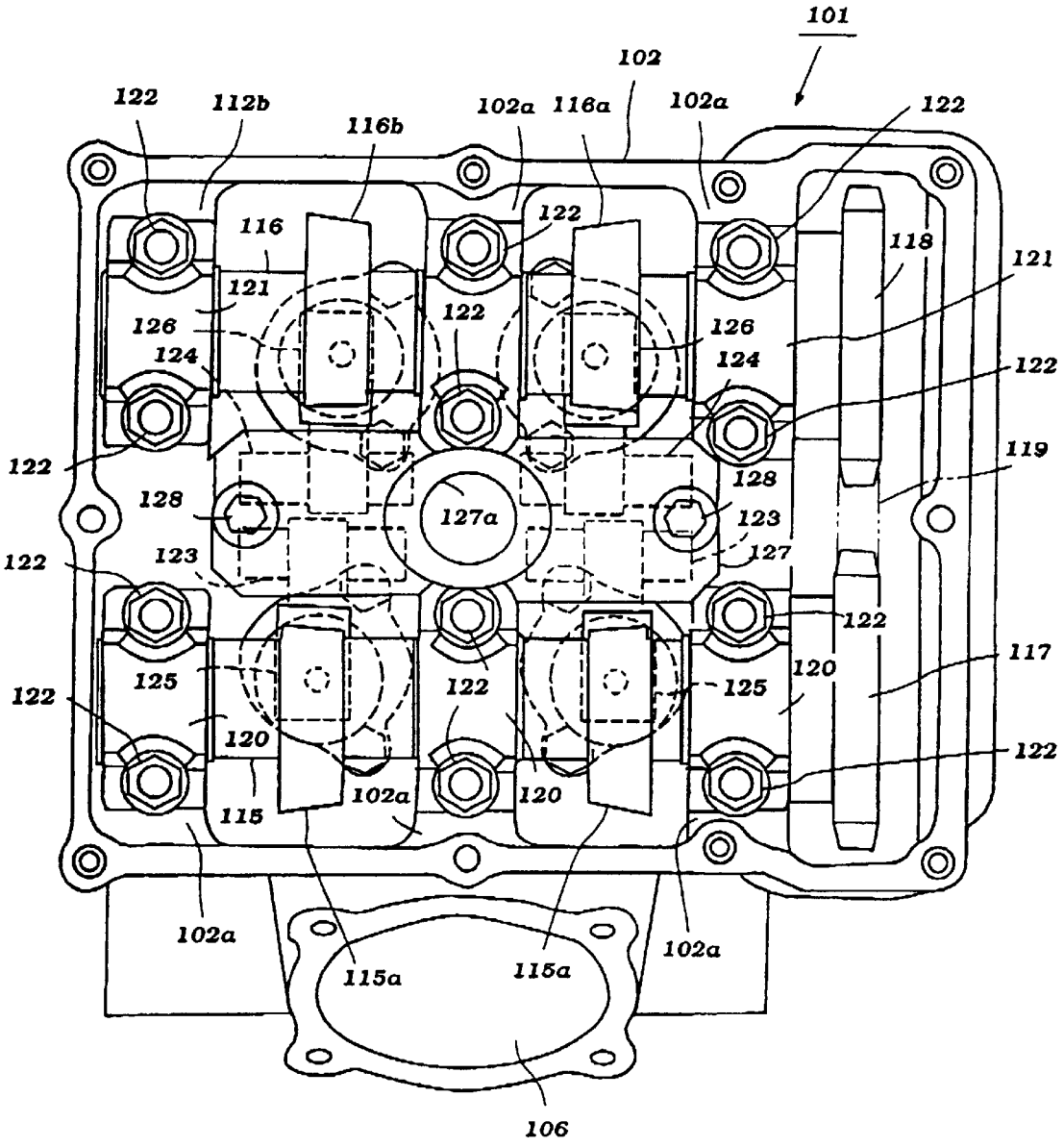
FIG. 8 is a plan view of an internal combustion engine provided with the valve driving mechanism according to an embodiment of the present invention, with its head cover removed.
Figure 9:
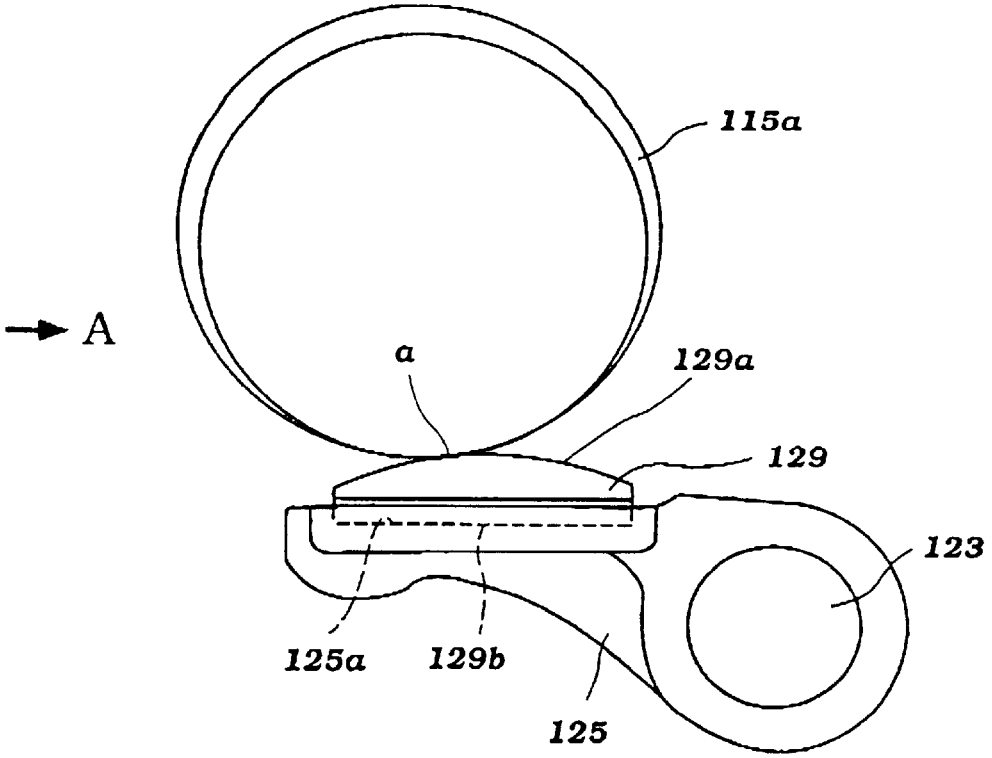
FIG. 9 is a side view showing the sliding contact state of the cam and the rocker arm of the valve driving mechanism according to an embodiment of the present invention.
Figure 10:
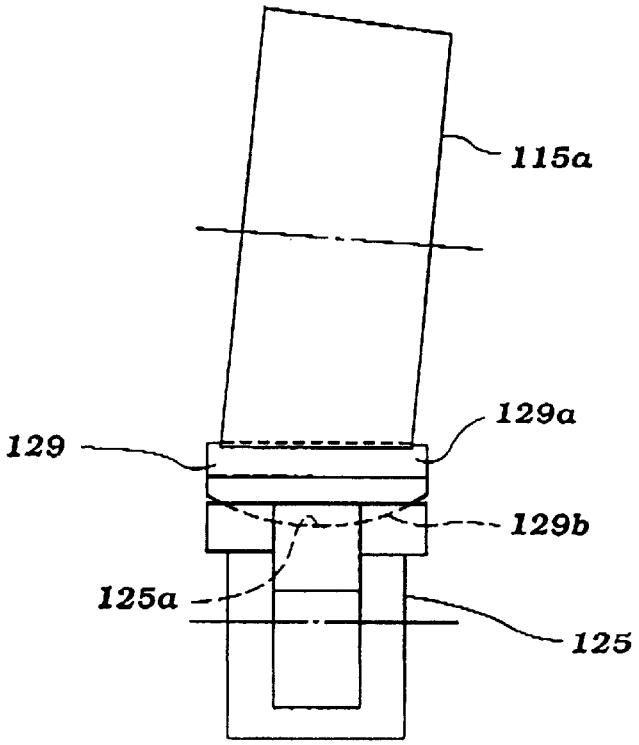
FIG. 10 is a front view showing the sliding contact state of the cam and the rocker arm of the valve driving mechanism according to an embodiment of the present invention (as seen in the direction of the arrow A in FIG. 9).
Figure 11:
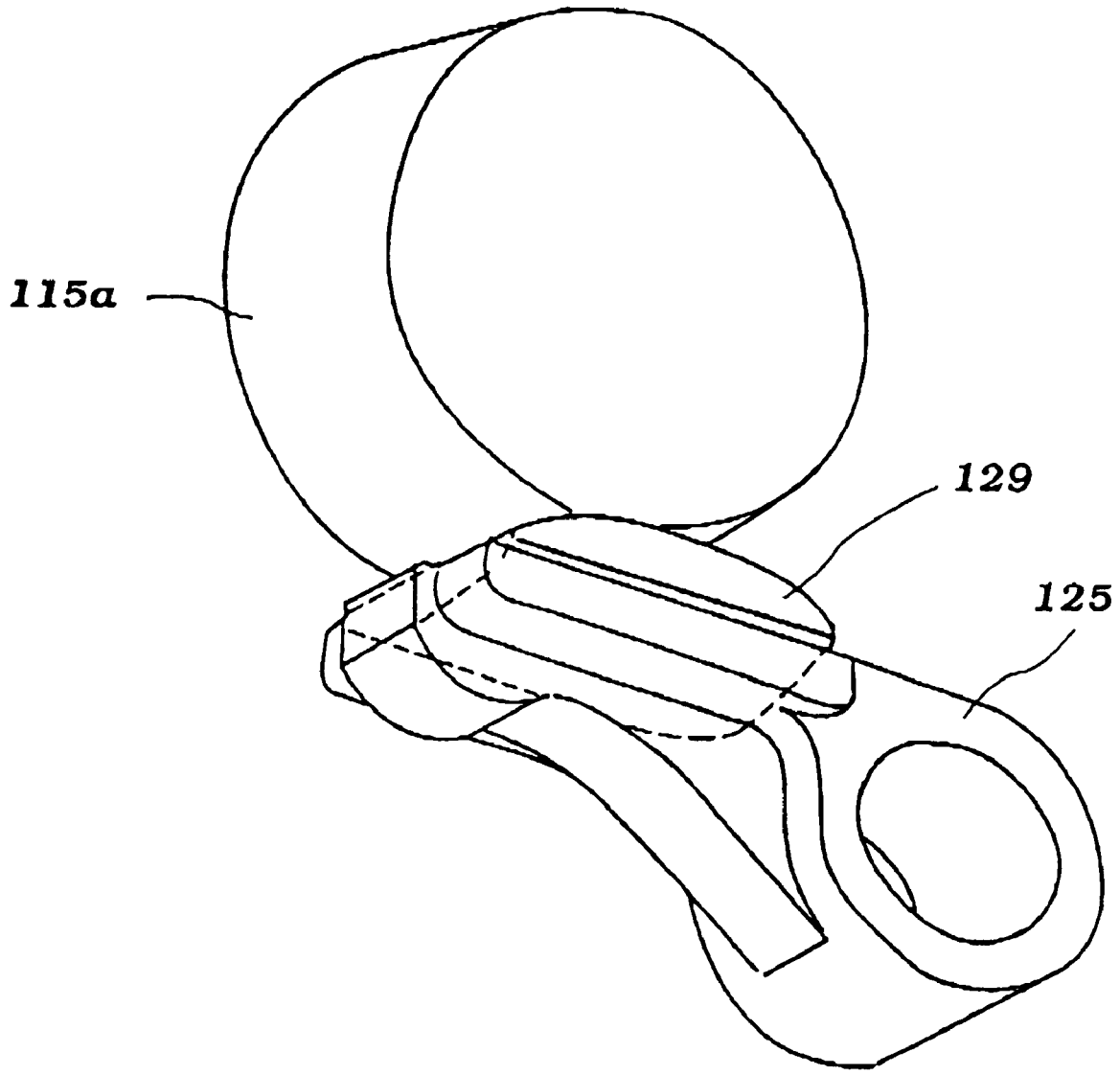
FIG. 11 is a perspective view showing the sliding contact state of the cam and the rocker arm of the valve driving mechanism according to an embodiment of the present invention.

FIG. 7 shows a lateral cross section of an upper portion (cylinder head portion) of an internal combustion engine provided with the valve driving mechanism according to a third embodiment of the present invention. FIG. 8 is a plan view of the same internal combustion engine with its head cover removed. FIG. 9 is a side view showing the sliding state of the cam and the rocker arm. FIG. 10 is a view as seen in the direction of the arrow A in FIG. 9. FIG. 11 is an oblique view of FIG. 10.

An internal combustion engine 101 according to the invention is of a four-stroke cycle, four-valve type and comprises as shown FIG. 7 a cylinder head 102 made of aluminum alloy, with two intake valves 103 and two exhaust valves 104 (only one for each is shown in FIG. 7).

The above-described cylinder head 102 is placed over a cylinder block (not shown) and a head cover 105 is attached over the cylinder head 102. A piston (not shown) is disposed for vertical sliding in a cylinder formed in the cylinder block, with the piston connected through a connecting rod (not shown) to the crankshaft (not shown).

As shown in FIG. 7, the cylinder head 102 is formed with two intake passages 106 and two exhaust passages 107 (only one for each is shown in FIG. 7). The intake ports 6*a* of the intake passages 106 and the exhaust ports 107*a* of the exhaust passages 107 respectively opening to the combustion chamber (S) are opened and closed with the intake valves 103 and the exhaust valves 104 according to appropriate timing to exchange gas as intended.

The constitution of the valve driving mechanism for opening and closing those ports with the intake valves 103 and the exhaust valves 104 according to an embodiment of the invention will be described.

As shown in FIG. 7, the intake valve 103 and the exhaust valve 104 are respectively made to pass through and retained with valve guides 108 and 109 press fitted into the cylinder head 102 so as to slide freely and are urged with air springs in the closing direction. That is, valve lifters 110 and 111 respectively attached to the top ends of each intake valve 103 and each exhaust valve 104 are fitted for free sliding within the recesses in housings 113 and 114 secured by means of a plural number of bolts 112 to the cylinder head 102 to form pressure chambers (not shown) in the recesses. Pressurized air supplied from a compressor (not shown) to respective pressure chambers constitutes air springs to urge the intake valve 103 and the exhaust valve 104 in the closing direction as described above.

In the internal combustion engine 101 of the invention as shown in FIG. 7, the intake valve 103 and the exhaust valve 104 are disposed to branch out radially in respective, three-dimensional directions. Accordingly the valve lifters 110, 111 and the housings 113, 114 are also disposed radially.

As shown in FIG. 8, bearing bosses 102*a* and 102*b* on the intake and exhaust sides opposing each other are formed on both outer sides (with respect to respective valve rows) of the intake and exhaust valves 103 and 104 of each cylinder of the cylinder head 102. On the upper surfaces of the bearing bosses 102*a* and 102*b* are respectively formed semi-tubular bearings (not shown). An intake camshaft 115 and an exhaust camshaft 116 are respectively rotatably supported with the bearings parallel to each other. Sprockets 117 and 118 are respectively attached to each one end of the intake camshaft 115 and the exhaust camshaft 116. An endless timing belt 119 is routed over the sprockets 117 and 118 and a sprocket (not shown) attached to one end of the above-mentioned crankshaft. It may also be constituted to transmit the rotation of the crankshaft through a multiple-gear train to the intake and exhaust camshafts 115 and 116.

Both upper halves of the intake camshaft 115 and the exhaust camshaft 116 are respectively supported with bearing caps 120 and 121 attached to the top surfaces of the bearing bosses 102*a* and 102*b* of the cylinder head 102 using bolts 122.

Two intake cams 115*a* are formed side by side integrally with parts of the intake camshaft 115 opposite the two intake valves 103. Likewise, two exhaust cams 116*a* are formed side by side integrally with parts of the exhaust camshaft 116 opposite the two exhaust valves 104. Those intake and exhaust cams 115*a* and 116*a* are made in three-dimensional shape with their sliding surfaces (peripheral surfaces) in tapered shape.

The valve driving mechanism of the embodiment is of the rocker arm type as shown in FIGS. 7 and 8 in which the four rocker arms 125 and 126 swinging about the rocker shafts 123 and 124 are disposed between the intake camshaft 115 and the exhaust camshaft 116, the rotation of the intake camshaft 115 and the exhaust camshaft 116 is converted through the rocker arms 125 and 126 into sliding movement of the intake valve 103 and the exhaust valve 4 so as to open and close the intake and exhaust ports by driving the intake valve 103 and the exhaust valve 104 according to appropriate timing and exchange gas as intended.

In this embodiment as shown in FIG. 7, a holder 127 as a separate component is secured using a bolt 128 in a space, formed below the top surface (the surface to which the head cover 105 is attached) and between the intake and exhaust camshafts 115 and 116, to support four rocker shafts 123, 124 which in turn support four rocker arms 125, 126 for swinging. The holder 127 is made of an iron-based material having higher strength and rigidity than aluminum alloy and, as shown in FIG. 8, its central portion has a plug hole 127*a*.

The top surfaces of the fore-ends of the rocker arms 125, 126 extending sideways from the holder 127 are in contact with the intake and exhaust cams 115*a*, 116*a* through slippers 129, 130. The underside surfaces of the fore-ends of the rocker arms 125, 126 are in contact with the top ends of the intake and exhaust valves 103, 104. In the valve driving mechanism of this embodiment as shown in FIG. 7, the centers of the intake and exhaust camshafts 115 and 116 are located on the axial center lines of the intake and exhaust valves 103, 104.

In the internal combustion engine 1 of this embodiment, the intake and exhaust cams 115*a*, 116*a* are made in three-dimensional shape because the intake and exhaust valves 103, 104 are disposed radially in three-dimensions as described above. The taper angles of the sliding surfaces of the intake and exhaust cams 115*a*, 116*a* are designed so that the axes of the intake and exhaust valves 103, 104 intersect the sliding surfaces at right angles.

The rocker shafts 123, 124 for bearing-supporting the rocker arms 125, 126 on the holder 127 are disposed generally parallel (within a deviation angle of 1 degree) to the intake and exhaust camshafts 115 and 116 in plan view. In side view, however, they are disposed with tilt angles of the intake and exhaust valves 103, 104 relative to the intake and exhaust camshafts 115 and 116 (relative to the crankshaft direction).

In the valve driving mechanism of this embodiment, the slippers 129, 130 of the rocker arms 125, 126 are separate components from the rocker arms 125, 126 and supported for free swinging in vertical planes parallel to the axes of the rocker shafts 123, 124 (in planes parallel to the paper surface of FIG. 10).

The constitution of the slipper 129 and the rocker arm 125 on the intake side will be described in reference to FIGS. 9 to 11. Since the constitution of the slipper 30 and the rocker arm 126 on the exhaust side is similar to that on the intake side, drawings and explanations therefor are omitted.

As shown in FIG. 9, the top surface (sliding contact surface) 129*a* of the slipper 129 is made in convex or arcuate curved shape as seen in the axial direction of the rocker shaft 123. The underside (supported surface) 129*b* of the slipper 129 is made in convex or arcuate curved shape as seen in the direction normal to the rocker shaft 123.

On the other hand as shown in FIG. 10, the supporting surface 25*a* of the rocker arm 25 for supporting the slipper 129 is made complementarily concave corresponding to the convex surface shape of the underside 129*b* of the slipper 129.

The slipper 129 is supported for swinging, in a vertical plane which is parallel to the axis of the rocker shaft 123, as its convex underside 129*b* is fitted and received in the concave supporting surface 125*a*, and is in line contact with the point "a" shown in FIG. 9 on the sliding surface of the intake cam 115*a*. Likewise, the slipper 130 of the rocker arm 126 is also supported for swinging, in a vertical plane which is parallel to the axis of the rocker shaft 124, and in line contact with the exhaust cam 116*a*.

The function of the valve driving mechanism of the invention will be explained.

When the internal combustion engine 101 is started and its crankshaft (not shown) is rotated, the crankshaft rotation with its speed reduced to a half through the sprocket (not shown), the timing belt 119, and the sprockets 117, 118 (shown in FIG. 8) is transmitted to the intake and exhaust camshafts 115 and 116, so that the intake and exhaust camshafts 115, 116 and the intake and exhaust cams 115*a*, 116*a* are driven for rotation at a specified speed (half the rotation speed of the crankshaft).

When the intake and exhaust cams 115*a*, 116*a* are driven for rotation as described above, the rocker arms 125, 126 are pushed down with the intake and exhaust cams 115*a*, 116*a* in indirect contact with the rocker arms 125, 126 through the slippers 129, 130 according to appropriate timing, so that the rocker arms 125, 126 depress the intake and exhaust valves 103, 104 against the urging force of the air spring and that the ports are respectively opened for specified periods of time to perform intended gas exchange.

As described above in this embodiment, since the slippers 129, 130 of the rocker arms 125, 126 are made as separate components and supported for free swinging, the slippers 129, 30 swing on the rocker arms 25, 26 due to dimensional errors in machining and in assembly work, so that the contact between the slippers 129, 130 and the intake and exhaust cams 115*a*, 116*a* is maintained in a stabilized line contact state. Therefore, it is possible to realize the line contact and restrict friction and heat generation on the sliding surfaces of the components without requiring high precision machining of the slippers 129, 130 and the intake and exhaust cams 115*a*, 116*a*.

In this embodiment, since the bearings for supporting the intake and exhaust camshafts 115, 116 are provided also between the two the intake valves 103 and the two exhaust valves 104, the rigidity for supporting the intake and exhaust camshafts 115, 116 is increased and the deflective deformation of the intake and exhaust camshafts 115, 116 is restricted to a small amount.

In this embodiment, since the centers of the intake and exhaust camshafts 115 and 116 are located on the axial center lines of the intake and exhaust valves 103, 104, loads acting onto the rocker shafts 123, 124 are reduced, so that the durability of the rocker shafts 123, 124 is improved.

While the above description is related to the application of the invention to a four-valve type engine having two intake valves and two exhaust valves, it is a matter of course that this invention is also applicable to any other internal combustion engines as long as they employ the rocker arms in the valve driving mechanism.

Effects of the Above Embodiment

As is clear from the above description, with this embodiment, an effect is obtained that, since the slippers of the rocker arms are made as separate components and supported for free swinging, it is possible to maintain the contact between the slippers and the intake and exhaust cams in the state of line contact in a stabilized manner as the slippers swing on the rocker arms due to dimensional errors in machining and in assembly work, without requiring high precision machining of the slippers and the intake and exhaust cams.

Fourth Embodiment

Figure 12:
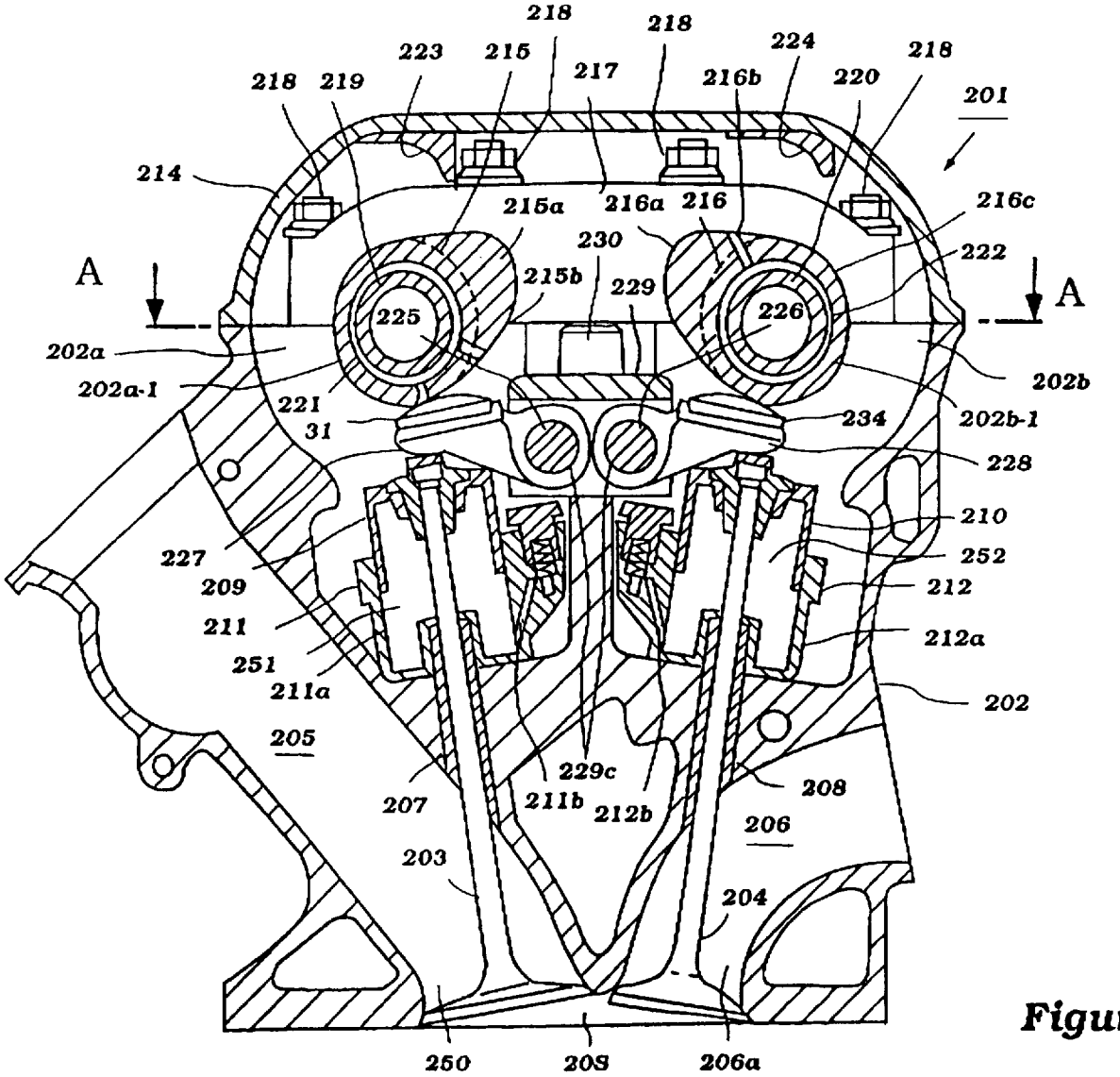
FIG. 12 shows a lateral cross section of the upper part (cylinder head area) of a multi-cylinder engine provided with a valve driving mechanism of the invention (as seen along the line B—B in FIG. 13).
Figure 13:
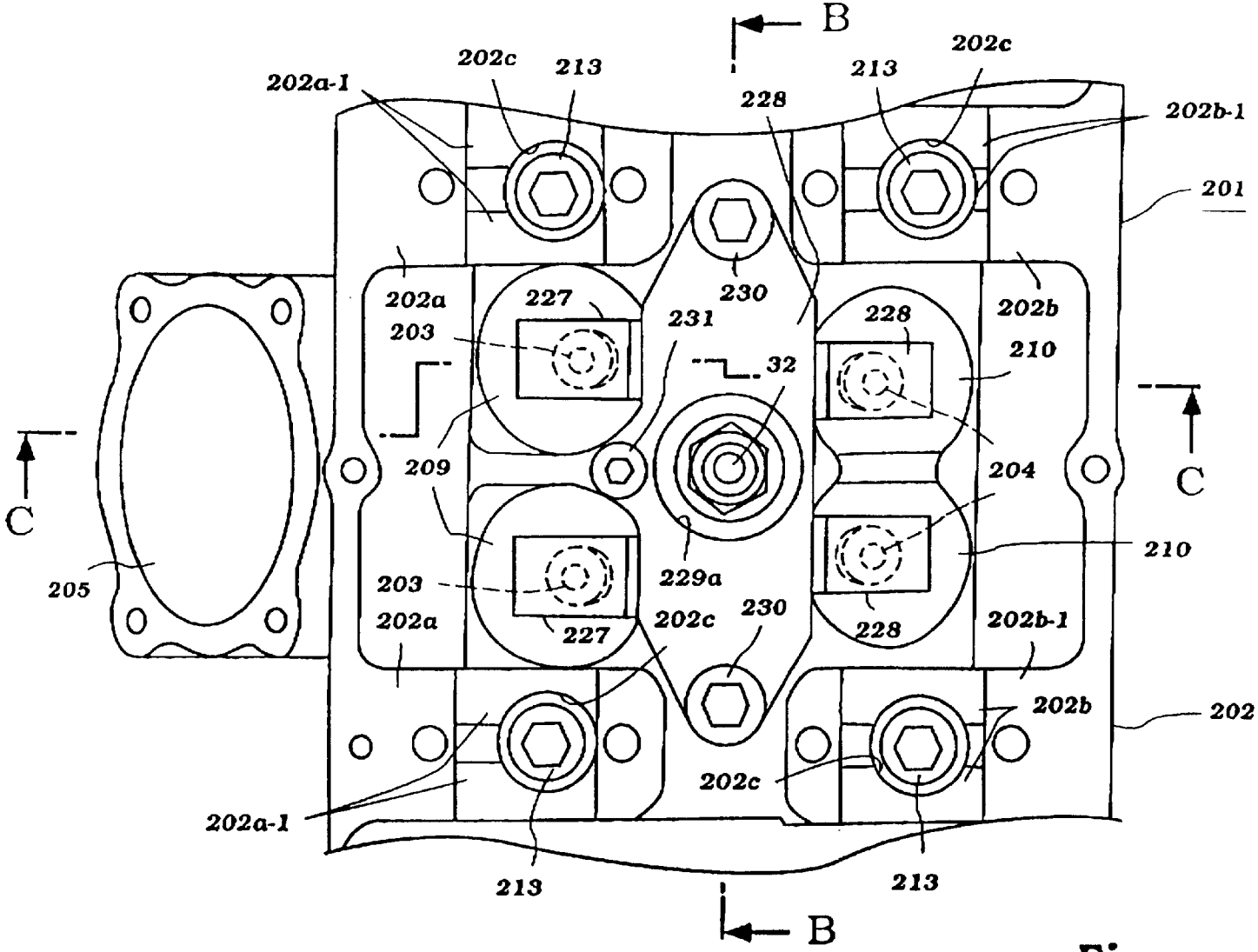
FIG. 13 is a view as seen along the arrows A—A in FIG. 12.
Figure 14:
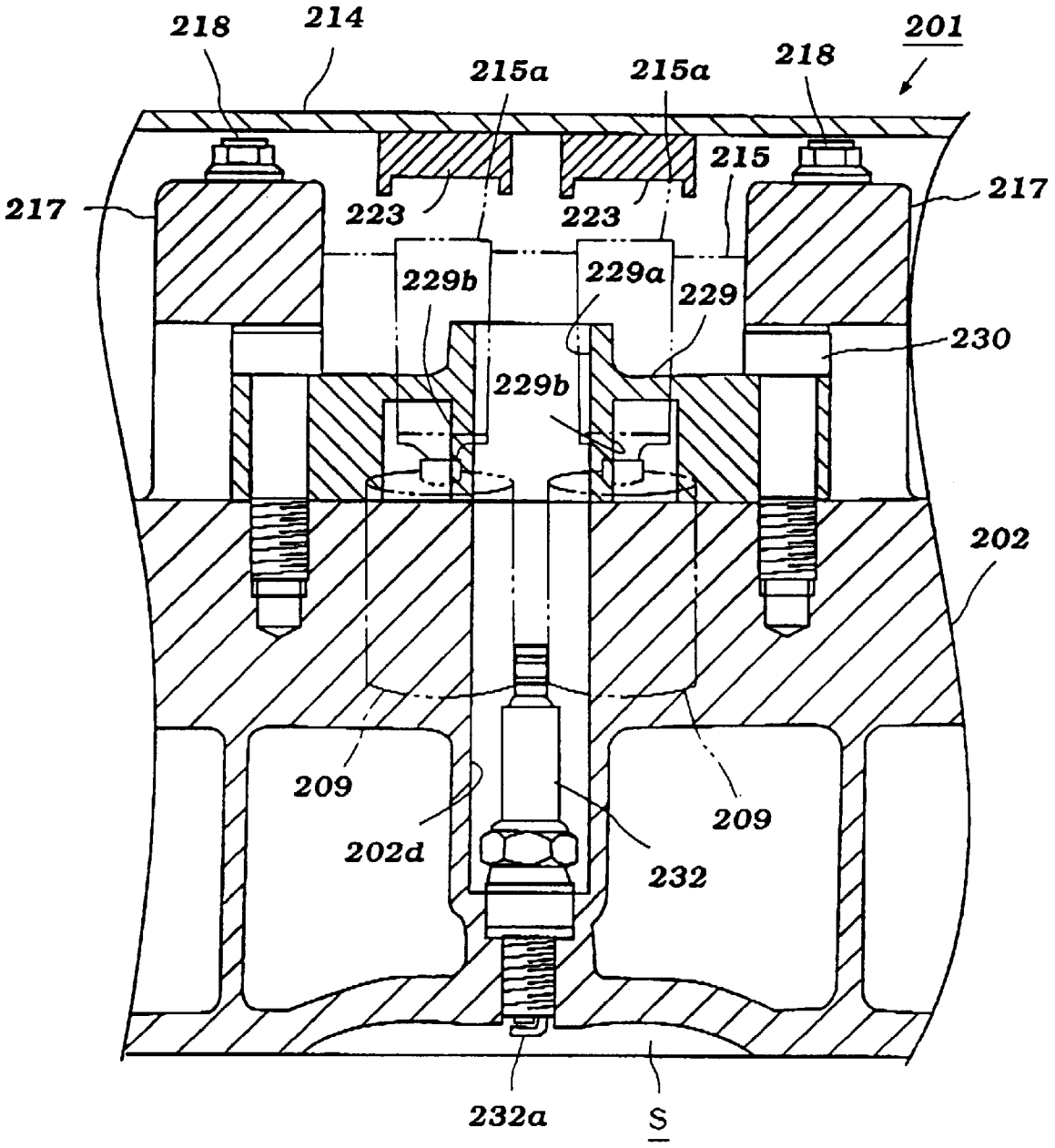
FIG. 14 shows a cross section as seen along the line C—C in FIG. 13.

FIG. 12 shows a lateral cross section of the upper part (cylinder head area) of a multi-cylinder engine provided with a valve driving mechanism of a fourth embodiment of the present invention (as seen along the line B—B in FIG. 13). FIG. 13 is a view as seen along the line A—A in FIG. 12. FIG. 14 shows a cross section as seen along the line C—C in FIG. 13.

An internal combustion engine 201 of the invention is of a four-stroke cycle, four-valve type and comprises as shown FIG. 12, for each cylinder, a cylinder head 202 made of aluminum alloy, with two intake valves 203 and two exhaust valves 204 (only one for each is shown in FIG. 12).

The above-described cylinder head 202 is placed over a cylinder block (not shown). A piston (not shown) is disposed for vertical sliding in each cylinder formed in the cylinder block, with the piston connected through a connecting rod (not shown) to the crankshaft (not shown).

As shown in FIG. 12, the cylinder head 202 is provided with two intake passages 205 and two exhaust passages 206 for each cylinder (only one for each is shown in FIG. 12). The intake port 205*a* of the intake passage 205 and the exhaust port 206*a* of the exhaust passage 206 respectively opening to the combustion chamber (S) are opened and closed with the intake valves 203 and the exhaust valves 204 according to appropriate timing to exchange gas as intended.

The constitution of the valve driving mechanism for opening and closing those ports with the intake valves 203 and the exhaust valves 204 according to an embodiment of the present invention will be described.

As shown in FIG. 12, the intake valve 203 and the exhaust valve 204 are respectively made to pass through and retained with valve guides 207 and 208 press-fitted into the cylinder head 202 so as to slide freely and are urged with an air spring in the closing direction. That is, valve lifters 209 and 210 respectively attached to the top ends of each intake valve 203 and each exhaust valve 204 are fitted for free sliding within the recesses 211*a* and 212*a* formed in housings 211 and 12 attached to the cylinder head 2 to form pressure chambers S1 and S2 in the recesses 211*a* and 212*a*. Pressurized air supplied from a compressor (not shown) through passages 211*b* and 212*b* to respective pressure chambers constitutes the air spring to urge the intake valve 203 and the exhaust valve 204 in the closing direction as described above.

In the multi-cylinder engine 201 of the embodiment as shown in FIG. 12, the intake and exhaust valves 203 and 204 in lateral cross section (in the direction of engine width) are tilted or disposed radially to diverge upward, and in longitudinal cross section (longitudinally) they are parallel to each other and vertical.

As shown in FIG. 13, head attachment bosses 202*a* and 202*b* on the intake and exhaust sides opposing each other are formed on both outer sides (with respect to respective valve rows) of the intake and exhaust valves 203 and 204 of each cylinder of the cylinder head 202. On the upper surfaces of the head attachment bosses 202*a* and 202*b* are respectively formed semi-tubular, double bearings 202*a*-1 and 202*b*-1. The double bearings 202*a*-1 and 202*b*-1 each has in its central area a round bolt insertion hole 202*c*. The cylinder head 202 is attached onto the top of the cylinder block (not shown) using head bolts 213 passed through the bolt insertion holes 202*c*. A head cover 214 made of aluminum alloy is placed over the top surface of the cylinder head 202 (as shown in FIGS. 12 and 14).

As shown in FIG. 12, an intake camshaft 215 and an exhaust camshaft 216 are rotatably supported with the double bearings 202*a*-1 and 202*b*-1 parallel to each other in the longitudinal direction (in the direction perpendicular to the surface of FIG. 12) on the top surfaces on the intake and exhaust sides of the cylinder head 202. The upper halves of the intake camshaft 215 and the exhaust camshaft 216 are supported with an integral type of bearing cap 217 made of aluminum alloy. The bearing cap 217 is attached on the top surfaces of the attachment bosses 202*a* and 202*b* on the opposing intake and exhaust sides of the cylinder head 202 by means of four attachment bolts 218, so that an integral type of bearing cap 217 bridges the attachment bosses 202*a* and 202*b* on the opposing intake and exhaust sides.

For each cylinder, two (only one is shown) intake cams 215*a* are formed side by side integrally with parts of the intake camshaft 215 opposite the two intake valves 203. Likewise, two (only one is shown) exhaust cams 216*a* are formed side by side integrally with parts of the exhaust camshaft 216 opposite the two exhaust valves 4.

As shown in FIG. 12, insides of the intake and exhaust camshafts 215 and 216 are provided with oil passages 221 and 222 of a ring shape in cross section, as formed between the camshaft 215 and a pipe member 219, and between the camshaft 216 and a pipe member 220. The intake and exhaust cams 215*a* and 216*a* are respectively bored with oil holes 215*b* and 216*b* in fluid communication with the oil passages 221 and 222. The journal portions of the intake and exhaust camshafts 215 and 216 are respectively bored with oil holes 215*c* and 216*c*.

As shown in FIGS. 12 and 14, ribs 223 and 224 for receiving oil thrown up from the oil holes 215*b* and 216*b* respectively bored in the intake and exhaust cams 215*a* and 216*a* are provided at positions on the intake and exhaust sides of the inside surface of the head cover 214.

The valve driving mechanism of the invention is of the rocker arm type as shown in FIGS. 12 and 13 in which the four rocker arms 227 and 228 swinging about the rocker shafts 225 and 226 are disposed between the intake camshaft 215 and the exhaust camshaft 216, the rotation of the intake camshaft 215 and the exhaust camshaft 216 is converted through the rocker arms 227 and 228 into sliding movement of the intake valve 203 and the exhaust valve 204 so as to open and close the intake and exhaust ports with the intake valve 203 and the exhaust valve 204 according to appropriate timing and to exchange gas as intended.

In this embodiment, a constitution is employed in which a space is formed below the top surface (on which the head cover 214 is attached) of the cylinder head 202 and between the intake and exhaust camshafts 215 and 216. A holder 229 as a separate component for each cylinder is accommodated and secured in this space using two large bolts 230 and a small bolt 231, to support four rocker shafts 225, 226 which in turn support four rocker arms 227, 228 for swinging.

The holder 229 is made of an iron-based material which is higher in both strength and rigidity than aluminum alloy and, as shown in FIG. 14, its central portion has a plug hole 229*a* and its both side portions have cut grooves 229*b* for the rocker arms 227 and 228 to fit in. The holder 229 is also provided with four rocker shaft holes 229*c* (shown in FIG. 12) for the rocker shafts 225 and 226 to fit in, parallel to the intake and exhaust camshafts 215 and 216 (in the direction perpendicular to the surface of FIG. 12).

As shown in FIG. 14, an ignition plug 223 is made to pass through the plug holes 229*a* and 202*d* bored respectively through the holder 229 and the cylinder head 202. The ignition plug 232 is screwed into the cylinder head 202 with its electrode portion 232*a* facing the central area of the combustion chamber S.

The top surfaces of the fore-ends of the rocker arms 227, 228 extending sideways from the holder 229 are in contact with the intake and exhaust cams 215*a*, 216*a* through slippers 233, 234. The underside surfaces of the fore-ends of the rocker arms 227, 228 are in contact with the top ends of the intake and exhaust valves 203, 204. In the valve driving mechanism of this embodiment as shown in FIG. 12, the centers of the intake and exhaust camshafts 215 and 216 are located on the axial center lines of the intake and exhaust valves 203, 204.

The function of the valve driving mechanism of an embodiment of the present invention will be explained.

When the internal combustion engine 201 is started and its crankshaft (not shown) is rotated, the crankshaft rotation is transmitted to the intake and exhaust camshafts 215 and 216, so that the intake and exhaust camshafts 215, 216 and the intake and exhaust cams 215*a*, 216*a* are driven for rotation at a specified speed (half the rotation speed of the crankshaft).

When the intake and exhaust cams 215*a*, 216*a* are driven for rotation as described above, the rocker arms 227, 228 are pushed down with the intake and exhaust cams 215*a*, 216*a* in contact with the fore-ends of the rocker arms 227, 228 according to appropriate timing, so that the rocker arms 227, 228 depress the intake and exhaust valves 203, 204 against the urging force of the air spring and that the intake and exhaust ports are opened for specified periods of time to perform intended gas exchange.

In this embodiment as described above, for each cylinder, since the holder 229 for supporting the rocker arms 227, 228 is attached below the head cover attachment surface of the cylinder head 202, it is possible to make the cylinder head 202 as a single, integral component in spite of employing the constitution in which the rocker shafts 225, 226 for swingably supporting the rocker arms 227, 228 are disposed between the intake and exhaust camshafts 215, 216. Therefore, it is unnecessary to divide the cylinder head into two, upper and lower parts as in the conventional design. As a result, the constitution is simplified, and the number of components, the number of assembly steps, and cost are reduced.

In this embodiment, each holder 229 is made of an iron-based material having high strength and rigidity as a separate component from the cylinder head. The upper halves of the intake and the exhaust camshafts 215, 216 are supported with the integral type of bearing cap 217 which bridges the attachment bosses 202*a*, 202*b* located on both opposing intake and exhaust sides of the cylinder head 202. As a result, rigidity of supporting the rocker arms 227, 228 is enhanced and the rocker arms 227, 228 are supported with a compact arrangement and a high rigidity.

Since the centers of the intake and exhaust camshafts 215 and 216 are located on the axial center lines of the intake and exhaust valves 203, 204, loads acting on the rocker shafts 225, 226 are reduced and the durability of the rocker shafts 225, 226 is improved.

In this embodiment, since the oil receiving ribs 223, 224 are provided on the inside surface of the head cover 204 attached over the cylinder head 202, oil sprayed out of the oil holes 215*b*, 216*b* bored in the intake and exhaust cams 215*a*, 216*a* is received with the ribs 223, 224 and drops by its own weight onto the sliding parts between the intake and exhaust cams 215*a*, 216*a* and the rocker arms 227, 228 and serves to lubricate and cool those parts, wear between the intake and exhaust cams 215*a*, 216*a* and the rocker arms 227, 228 is prevented, and heat generation due to friction is restricted.

While the above description is related to the application of the embodiment to a four-valve type engine having intake and exhaust valves, two for each, it is a matter of course that this invention is also applicable to any other multi-cylinder engines as long as they employ the rocker arms in the valve driving mechanism.

Effects of the Above Embodiment

As is clear from the above description, according to an embodiment of the present invention, in the valve driving mechanism for a multi-cylinder engine wherein rocker shafts for swingably shaft-supporting rocker arms are disposed between intake and exhaust camshafts, rotation of the intake and exhaust camshafts is converted into sliding movement of intake and exhaust valves to open and close intake and exhaust ports, since the holder for supporting the rocker arms is secured in a position below the head cover attachment surface of the integral type of cylinder head, effects are provided that the integral type of cylinder head can be employed in spite of disposing the rocker shafts between the intake and exhaust camshafts, and that the rocker arms are supported compactly with a high rigidity.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A valve drive system for an engine provided with a combustion chamber defined at least in part by a cylinder head, and a plurality of poppet type valves disposed radially in said cylinder head with stems thereof defining skewed, reciprocal axes, said valve drive system comprising: a camshaft journalled for rotation about a camshaft axis in said cylinder head, said camshaft having a plurality of three-dimensional cams; and a plurality of rocker arms, each associated with a respective one of said three-dimensional cams and having a boss portion journalled for pivotal movement about a first axis upon a rocker shaft, a three dimensional follower portion engaged with the respective three-dimensional cam for effecting movement of said follower portion about a second pivotal axis relative to said three-dimensional cam, and an actuating portion engaged with the respective poppet type valve for operating said valves by the respective rocker arms through pivotal movement of said actuating portion about a third pivotal axis relative to the respective of said valves, said boss portions of said rocker being journalled on the respective of said rocker shafts for tilting movement in a direction perpendicular to its respective pivotal axis to provide line contact between said follower portion and said three-dimensional cam surface and said actuating portion and the respective valve, said boss portions of said rocker arms and the respective of said rocker shafts define a tapered cavity therebetween for permitting said tilting movement of said rocker arm relative to the axis of said rocker shaft.

2. The valve drive system according to claim 1, wherein the distance between the rocker shaft and the point where the three-dimensional cam is engaged with the rocker arm follower portion, is less than the distance between the rocker shaft and the point where the rocker arm actuating portion is engaged with the valve.

3. The valve drive system according to claim 1, wherein said rocker shaft is inclined with respect to the axis of the camshaft when viewed from the cylinder axis direction.

4. The valve drive system according to claim 1, wherein the rocker shaft is cylindrical in configuration and the rocker arm boss portion has a tapered bore therein.

5. The valve drive system according to claim 4, wherein the bore of the rocker arm boss portion has a hourglass-shaped configuration with a smaller diameter central portion and tapering larger diameter end portions.

6. The valve drive system according to claim 1, wherein the valves comprise at least two intake valves and at least two exhaust valves an a corresponding number of intake and exhaust cams formed on respective intake and exhaust camshafts.

7. The valve drive system according to claim 6, further comprising bearings for supporting the intake and exhaust camshafts, said bearings being disposed between the intake and exhaust valves adjacent to each other.

8. The valve drive system according to claim 1, wherein the rocker shaft has a barrel-shaped configuration with a larger diameter central p and tapering smaller diameter end portions.

* * * * *

UNITED STATES PATENT AND TRADEMARK OFFICE

CERTIFICATE OF CORRECTION

PATENT NO. : 6,125,806
DATED : October 3, 2000
INVENTOR(S) : Kengo Nishi et al

It is certified that error appears in the above-identified patent and that said Letters Patent is hereby corrected as shown below:

Column 15, claim 1,
Line 29, after "rocker", insert -- arms --.

Column 15, claim 8,
Line 31, delete "p", and insert -- portions --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*